US006135663A

United States Patent [19]

Tan

[11] Patent Number: 6,135,663

[45] Date of Patent: Oct. 24, 2000

[54] PHOTOGRAPH ALBUM PAGE

[76] Inventor: Whang Kwee Tan, 17 A. Ah Soo Garden, Singapore 539976, Singapore

[21] Appl. No.: 09/497,837

[22] Filed: Feb. 3, 2000

Related U.S. Application Data

[63] Continuation-in-part of application No. 09/394,466, Sep. 11, 1999, and a continuation-in-part of application No. 09/234, 222, Jan. 20, 1999, Pat. No. 5,997,041, and a continuation-in-part of application No. 09/350,612, Jul. 9, 1999, Pat. No. 6,056,494, and a continuation-in-part of application No. 09/369,708, Aug. 6, 1999.

[51] Int. Cl.[7] ..... B42F 13/00

[52] U.S. Cl. ..... 402/79; 281/38; 206/455

[58] Field of Search ..... 402/79, 4, 73, 402/70, 80 R, 80 L, 80 P; 281/38, 51, 31; 206/455

[56] References Cited

U.S. PATENT DOCUMENTS

| | | | |
|---|---|---|---|
| 4,925,720 | 5/1990 | Hansen | 402/79 X |
| 5,738,460 | 4/1998 | Flynn | 402/79 X |
| 5,915,874 | 6/1999 | Wilson et al. | 402/79 |
| 6,004,061 | 12/1999 | Monico et al. | 402/79 |

*Primary Examiner*—Willmon Fridie, Jr.

[57] ABSTRACT

A photograph album page includes a rectangular backing sheet having an upper edge and a parallel lower edge and having an interior edge and a parallel exterior edge and an exterior region between the vertical centerline and the exterior edge and an interior region between the vertical centerline and the interior edge. A plurality of small holes are formed through the exterior region including a lower line between the horizontal centerline and the lower edge and an upper line between the horizontal centerline and the upper edge. An additional plurality of small holes are formed through the interior region and include an inner line of holes closely spaced from the interior edge and an outer line distantly spaced from the interior edge. A rectangular transparent large bag is formed with an exterior edge adjacent to the exterior edge of the sheet and an unsealed open edge in proximity to the vertical centerline. A rectangular transparent small bag is formed with an interior edge adjacent to the interior edge of the sheet and an unsealed open edge in proximity to the vertical centerline. A small rectangular space is formed between the open edges of the large bag and the small bag. Couplings between portions of the bags through the holes form a unitive page.

13 Claims, 7 Drawing Sheets

FIG 1C
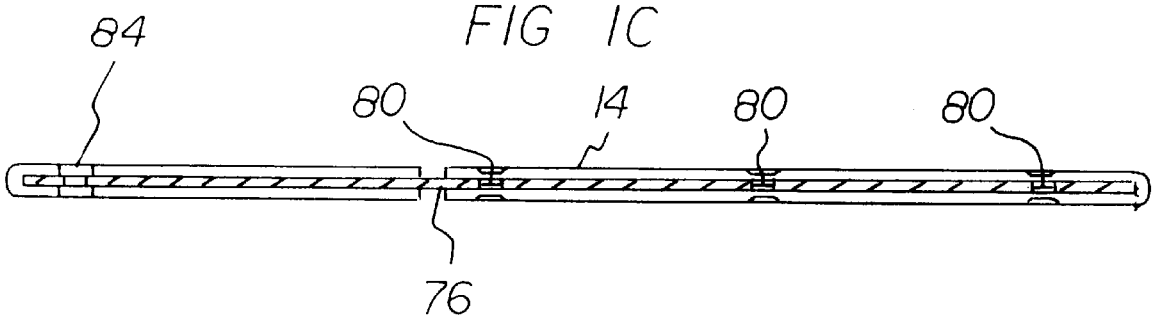
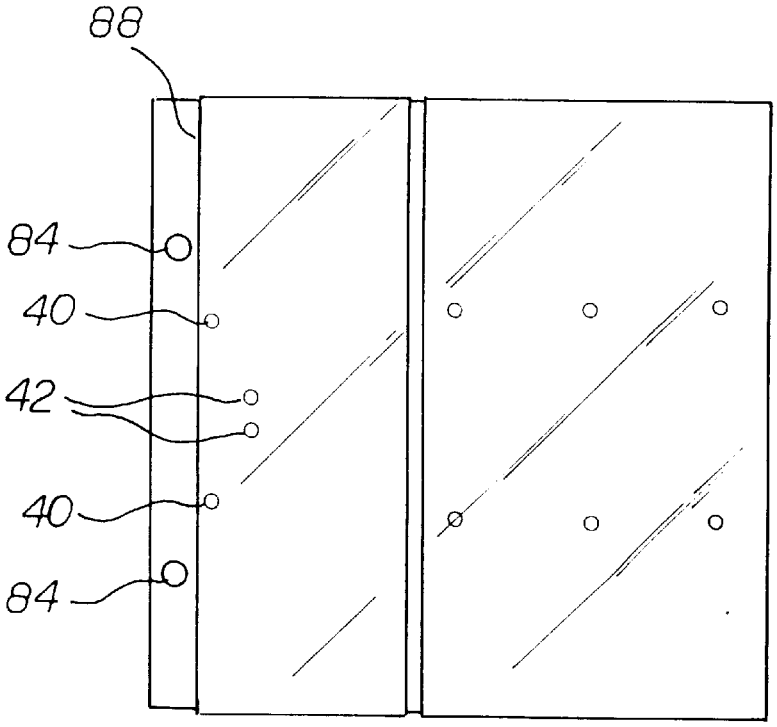
FIG 28

PHOTOGRAPH ALBUM PAGE

RELATED APPLICATIONS

This application is a continuation-in-part of co-pending application Ser. No. 09/394,466 filed Sep. 11, 1999, issued Ser. No. 09/234,222 filed Jan. 20, 1999, now U.S. Pat. No. 5,997,041 allowed Ser. No. 09/350,612 now U.S. Pat. No. 6,056,494 filed Jul. 9, 1999, and co-pending Ser. No. 09/369,708 filed Aug. 6, 1999, the subject matter of which is included herein by reference.

BACKGROUND OF THE INVENTION

1. Field of the Invention

The present invention relates to a photograph album page and more particularly pertains to displaying a plurality of photographs of a wide variety of sizes in a convenient manner.

2. Description of the Prior Art

The use of photograph album pages of known designs and configurations is known in the prior art. More specifically, photograph album pages of known designs and configurations previously devised and utilized for the purpose of displaying photographs through a wide variety of methods and apparatuses are known to consist basically of familiar, expected, and obvious structural configurations, notwithstanding the myriad of designs encompassed by the crowded prior art which has been developed for the fulfillment of countless objectives and requirements.

By way of example., U.S. Pat. No. 4,702,026 to Shaine discloses a method of making pages of a photo album. U.S. Pat. No. 5,242,522 to Moir discloses a method for producing a photo album page.

While these devices fulfill their respective, particular objectives and requirements, the aforementioned patents do not describe a photograph album page that allows displaying a plurality of photographs of a wide variety of sizes in a convenient manner.

In this respect, the photograph album page according to the present invention substantially departs from the conventional concepts and designs of the prior art, and in doing so provides an apparatus primarily developed for the purpose of displaying a plurality of photographs of a wide variety of sizes in a convenient manner.

Therefore, it can be appreciated that there exists a continuing need for a new and improved photograph album page which can be used for displaying a plurality of photographs of a wide variety of sizes in a convenient manner. In this regard, the present invention substantially fulfills this need.

SUMMARY OF THE INVENTION

In view of the foregoing disadvantages inherent in the known types of photograph album pages of known designs and configurations now present in the prior art, the present invention provides an improved photograph album page. As such, the general purpose of the present invention, which will be described subsequently in greater detail, is to provide a new and improved photograph album page and method which has all the advantages of the prior art and none of the disadvantages.

To attain this, the present invention essentially comprises a new an improved photograph album page for displaying a plurality of photographs of a wide variety of sizes in a convenient manner. First provided is a rectangular backing sheet. The backing sheet is of a flexible opaque material, preferably paper. The backing sheet has an upper edge and a parallel lower edge about 13 inches in length. The backing sheet also has an interior edge and a parallel exterior edge about 12.5 inches in length. In addition, the backing sheet has an upper surface and a lower surface. The backing sheet has a horizontal centerline and a vertical centerline forming an exterior region between the vertical centerline and the exterior edge and an interior region between the vertical centerline and the interior edge. A plurality of small holes are formed through the exterior region of the backing sheet. The small holes include a lower line of three horizontally aligned holes between the horizontal centerline and the lower edge. The small holes also include an upper line of three horizontally aligned holes between the horizontal centerline and the upper edge. An additional plurality of small holes are formed through the interior region of the backing sheet. This additional plurality of small holes includes an inner line of two vertically aligned holes closely spaced from the interior edge and in alignment with the holes of the upper line and the lower line respectively. The additional plurality of small holes also includes an outer line of two vertically aligned holes distantly spaced from the interior edge and closely spaced from the vertical centerline. Next provided is a rectangular transparent large bag. The large bag is fabricated of a flexible plastic material, preferably polypropylene. The large bag functions to receive and display photographs. The large bag is formed of an upper layer and a lower layer. The upper layer overlies the upper surface of the sheet. The lower layer overlies the lower surface of the sheet. The large bag has a sealed upper edge adjacent to the upper edge of the sheet. The large bag also has a sealed lower edge adjacent to the lower edge of the sheet. The large bag also has a sealed closed edge adjacent to the exterior edge of the sheet. And finally, the large bag has an unsealed open edge receiving the exterior region of the sheet and located in proximity to the vertical centerline. The unsealed open edge is provided for the passage of photographs to be received and supported by the large bag. A rectangular transparent small bag is next provided. The small bag is fabricated of a flexible plastic material, preferably polypropylene. The small bag functions to receive and display photographs. The small bag is formed of an upper layer and a lower layer. The upper layer overlies the upper surface of the sheet. The lower layer overlies the lower surface of the sheet. The small bag has a sealed upper edge adjacent to the upper edge of the sheet. The small bag also has a sealed lower edge adjacent to the lower edge of the sheet. The small bag also has a sealed closed edge adjacent to the interior edge of the sheet. Finally, the small bag has an unsealed open edge receiving the interior region of the sheet and located in proximity to the vertical centerline. The unsealed open edge is provided for the passage of photographs to be received and supported by the small bag. A small rectangular space is formed between the open edges of the large bag and the small bag. Heat sealed couplings are provided between portions of the bags and through the holes and form a unitive page with three similarly sized pockets in the exterior region and a plurality of dissimilarly sized pockets in the interior region. Two spaced circular apertures extend through the small bag and the sheet adjacent to the interior edge to facilitate mounting the page and similar pages into an album.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved photograph album page which has all of the advantages of the prior art photograph album pages of known designs and configurations and none of the disadvantages.

It is another object of the present invention to provide a new and improved photograph album page which may be easily and efficiently manufactured and marketed.

It is further object of the present invention to provide a new and improved photograph album page which is of durable and reliable constructions.

An even further object of the present invention is to provide a new and improved photograph album page which is susceptible of a low cost of manufacture with regard to both materials and labor, and which accordingly is then susceptible of low prices of sale to the consuming public, thereby making such photograph album page economically available to the buying public.

Even still another object of the present invention is to provide a photograph album page for displaying a plurality of photographs of a wide variety of sizes in a convenient manner.

Lastly, it is an object of the present invention to provide a new and improved photograph album page. The photograph album page includes a rectangular backing sheet having an upper edge and a parallel lower edge and has an interior edge and a parallel exterior edge and an exterior region between the vertical centerline and the exterior edge and an interior region between the vertical centerline and the interior edge. A plurality of small holes are formed through the exterior region including a lower line between the horizontal centerline and the lower edge and an upper line between the horizontal centerline and the upper edge. An additional plurality of small holes are formed through the interior region and include an inner line of holes closely spaced from the interior edge and an outer line distantly spaced from the interior edge. A rectangular transparent large bag is formed with an exterior edge adjacent to the exterior edge of the sheet and an unsealed open edge in proximity to the vertical centerline. A rectangular transparent small bag is formed with an interior edge adjacent to the interior edge of the sheet and an unsealed open edge in proximity to the vertical centerline. A small rectangular space is formed between the open edges of the large bag and the small bag. Couplings between portions of the bags through the holes form a unitive page.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1C is a cross-sectional view taken long line C—C of FIG. 1.

FIG. 28 shows an alternate embodiment of the invention.

The same reference numerals refer to the same parts throughout the various Figures.

DESCRIPTION OF THE PREFERRED EMBODIMENT

Figure 1:
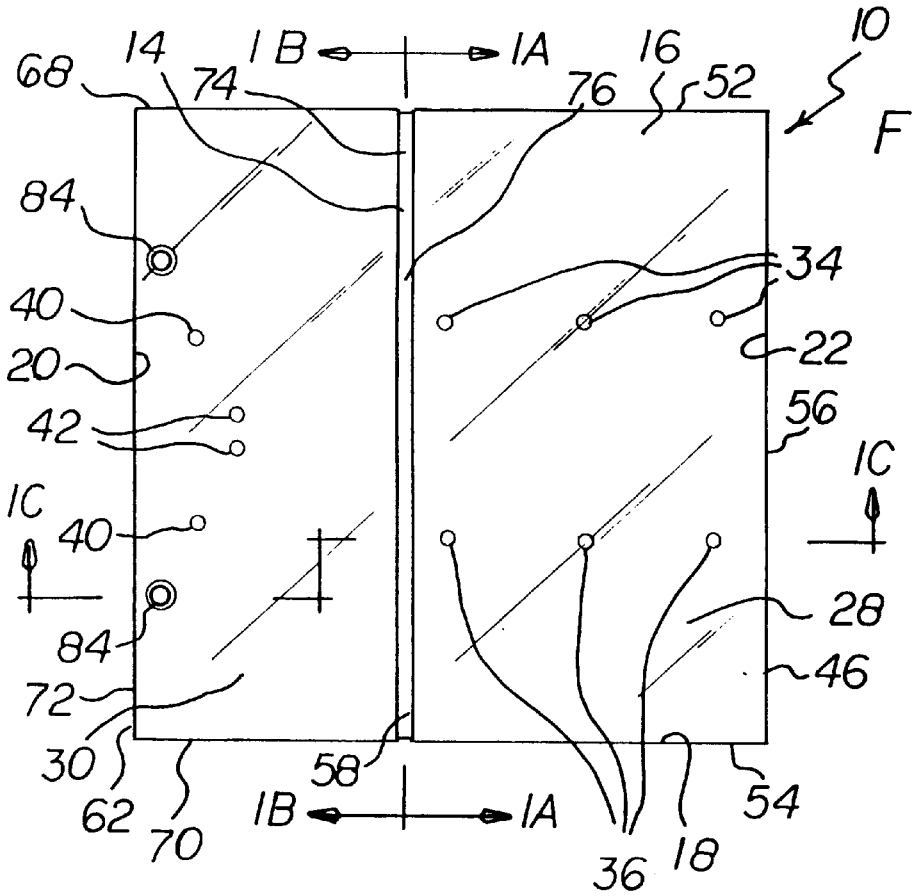
FIG. 1 is an elevational view of the new and improved photograph album page constructed in accordance with the principles of the present invention.
Figure 1A:
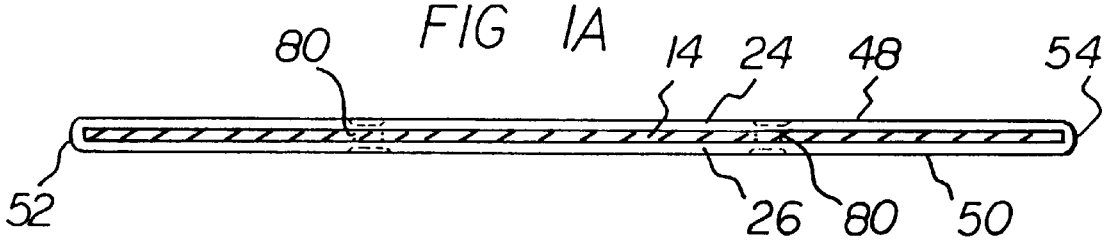
FIG. 1A is a cross-sectional view taken along line A—A of FIG. 1.
Figure 1B:
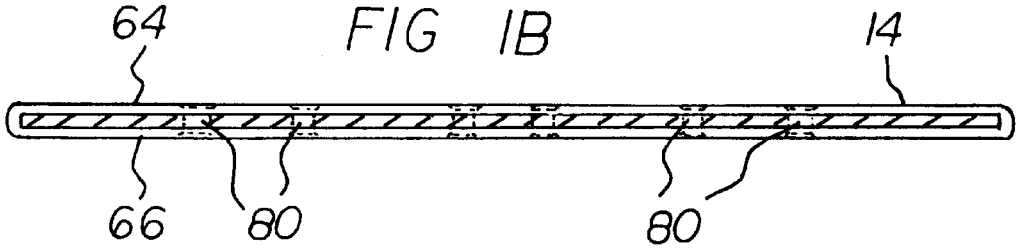
FIG. 1B is a cross-sectional view taken along line B—B of FIG. 1.

With reference now to the drawings, and in particular to FIG. 1 thereof, the preferred embodiment of the new and improved photograph album page embodying the principles and concepts of the present invention and generally designated by the reference numeral 10 will be described.

The present invention, the photograph album page 10 is comprised of a plurality of components. Such components in their broadest context include a rectangular backing sheet, an exterior region, a plurality of small holes formed through the exterior region, an additional plurality of small holes formed through the interior region, a rectangular transparent large bag, a rectangular transparent small bag, and couplings between portions of the bags through the holes to form a unitive page. Such components are individually configured and correlated with respect to each other so as to attain the desired objective.

First provided is a rectangular backing sheet 14. The backing sheet is of a flexible opaque material, preferably paper. The backing sheet has an upper edge 16 and a parallel lower edge 18 about 13 inches in length. The backing sheet also has an interior edge 20 and a parallel exterior edge 22 about 12.5 inches in length. In addition, the backing sheet has an upper surface 24 and a lower surface 26. The backing sheet has a horizontal centerline and a vertical centerline forming an exterior region 28 between the vertical centerline and the exterior edge and an interior region 30 between the vertical centerline and the interior edge.

A plurality of small holes 34, 36 are formed through the exterior region of the backing sheet. The small holes include a lower line of three horizontally aligned holes 34 between the horizontal centerline and the lower edge. The small holes also include an upper line of three horizontally aligned holes 36 between the horizontal centerline and the upper edge.

An additional plurality of small holes 40, 42 are formed through the interior region of the backing sheet. This additional plurality of small holes includes an inner line of two vertically aligned holes 40 closely spaced from the interior edge and in alignment with the holes of the upper line and the lower line respectively. The additional plurality of small holes also includes an outer line of two vertically aligned holes 42 distantly spaced from the interior edge and closely spaced from the vertical centerline.

Next provided is a rectangular transparent large bag 46. The large bag is fabricated of a flexible plastic material, preferably polypropylene. The large bag functions to receive and display photographs. The large bag is formed of an upper layer 48 and a lower layer 50. The upper layer overlies the upper surface of the sheet. The lower layer overlies the lower surface of the sheet. The large bag has a sealed upper edge 52 adjacent to the upper edge of the sheet. The large bag also has a sealed lower edge 54 adjacent to the lower edge of the sheet. The large bag also has a sealed closed edge 56 adjacent to the exterior edge of the sheet. And finally, the large bag has an unsealed open edge 58 receiving the exterior region of the sheet and located in proximity to the vertical centerline. The unsealed open edge is provided for the passage of photographs to be received and supported by the large bag.

A rectangular transparent small bag 62 is next provided. The small bag is fabricated of a flexible plastic material, preferably polypropylene. The small bag functions to receive and display photographs. The small bag is formed of an upper layer 64 and a lower layer 66. The upper layer overlies the upper surface of the sheet. The lower layer overlies the lower surface of the sheet. The small bag has a sealed upper edge 68 adjacent to the upper edge of the sheet. The small bag also has a sealed lower edge 70 adjacent to the lower edge of the sheet. The small bag also has a sealed closed edge 72 adjacent to the interior edge of the sheet. Finally, the small bag has an unsealed open edge 74 receiving the interior region of the sheet and located in proximity to the vertical centerline. The unsealed open edge is provided for the passage of photographs to be received and supported by the small bag. A small rectangular space 76 is formed between the open edges of the large bag and the small bag.

Heat sealed couplings 80 are provided between portions of the bags and through the holes and the sheet and form a unitive page with three similarly sized pockets in the exterior region and a plurality of dissimilarly sized pockets in the interior region.

Two spaced circular apertures 84 extend through the sheet adjacent to the interior edge to facilitate mounting the page and similar pages into an album.

Presently in the market there is not any pocket photograph album that could accommodate the various different combinations as described herein. For our purposes there are five sizes of photographs; 4 inches by 6 inches, 4 inches by 7 inches, 4 inches by 10 inches, 4 inches by 11 inches, 4 inches by 12 inches. What makes this page special is that this page is able to accommodate all the sizes and it can accommodate the different combinations of the photo sizes listed.

As can be seen from the foregoing, the page of the present invention is made up by coupling two polypropylene bags to pieces of paper. There are holes, which could be of any size or shape, punched in predetermined positions to the paper so that the bag and the paper could stay together when heat sealed.

Figure 4:
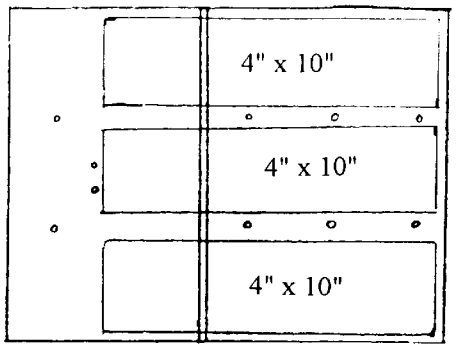
FIG. 4 is a showing of three photographs of size 4 inches by 10 inches.
Figure 7:
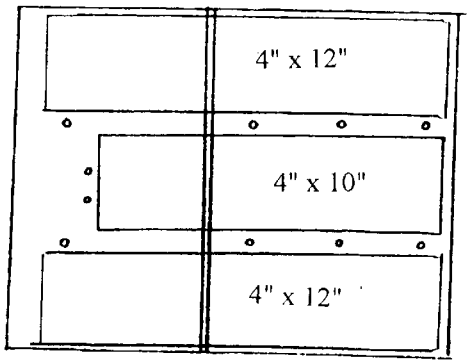
FIG. 7 is a showing of one photograph of size 4 inches and 10 inches and two photographs of size 4 inches by 12 inches.
Figure 3:
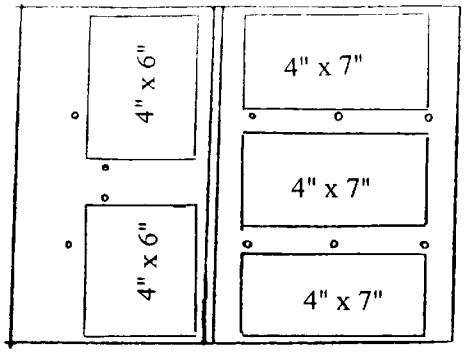
FIG. 3 is a showing of two photographs of size 4 inches by 6 inches and three photographs of size 4 inches by 7 inches.
Figure 6:
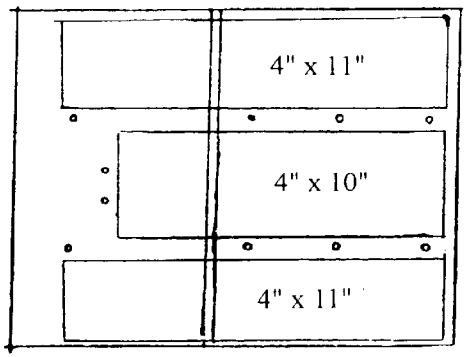
FIG. 6 is a showing of one photograph of size 4 inches by 10 inches and two photographs of size 4 inches by 11 inches.
Figure 2:
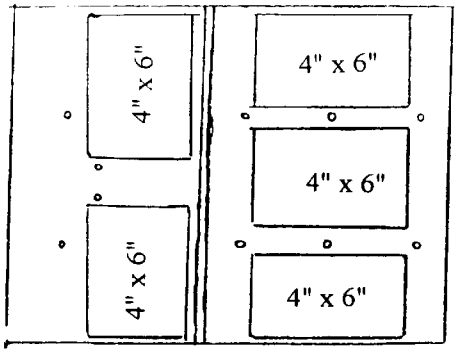
FIG. 2 is an illustration of five photographs of size 4 inch by 6 inch.
Figure 5:
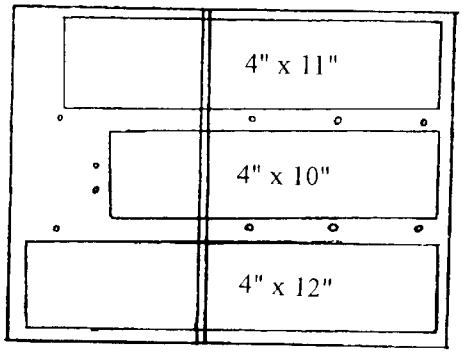
FIG. 5 is a showing of one photograph of size 4 inches by 10 inches, one photograph of size 4 inches by 11 inches and one photograph of size 4 inches by 12 inches.
Figure 10:
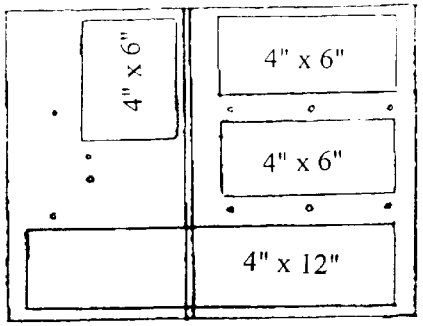
FIG. 10 is a showing of three photographs of size 4 inches by 6 inches and one photograph of size 4 inches by 12 inches.
Figure 13:
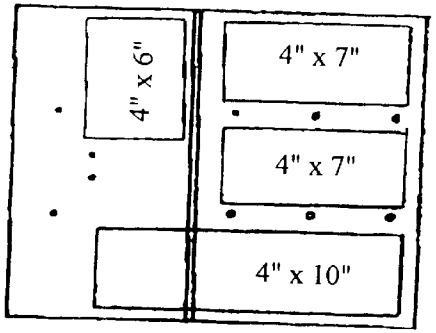
FIG. 13 is a showing of one photograph of size 4 inches by 6 inches and two photographs of size 4 inches by 7 inches and one photograph of size 4 inches by 10 inches.
Figure 9:
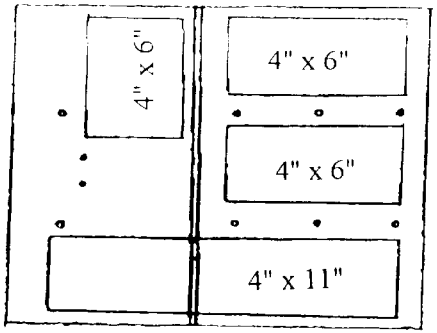
FIG. 9 is a showing of three photographs of size 4 inches by 6 inches and one photograph of size 4 inches by 11 inches.
Figure 12:
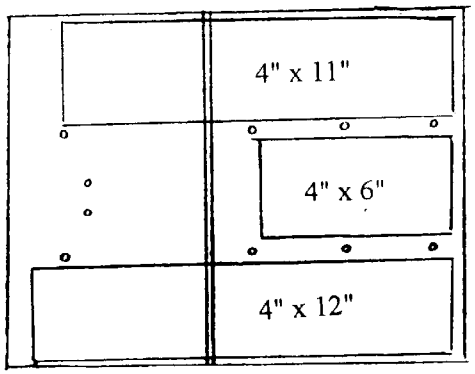
FIG. 12 is a showing of one photograph of size 4 inches by 6 inches and one photograph of size 4 inches by 11 inches and one photograph of 4 inches by 12 inches.
Figure 8:
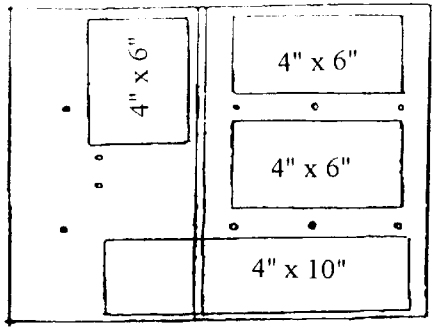
FIG. 8 is a showing of three photographs of size 4 inches by 6 inches and one photograph of size 4 inches by 10 inches.
Figure 11:
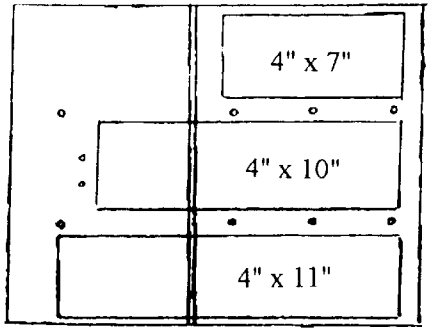
FIG. 11 is a showing of one photograph of size 4 inches by 6 inches and one photograph of size 4 inches by 10 inches and one photograph of 4 inches by 12 inches.
Figure 16:
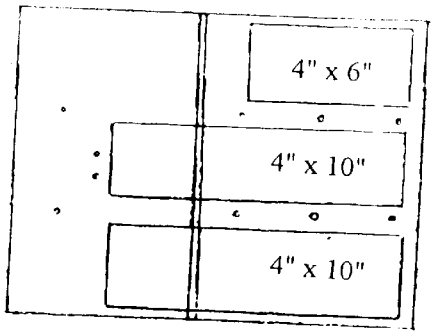
FIG. 16 is a showing of one photograph of size 4 inches by 6 inches and two photographs of size 4 inches by 10 inches.
Figure 15:
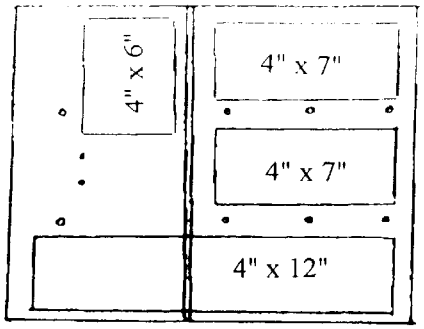
FIG. 15 is a showing of one photograph of size 4 inches by 6 inches and two photographs of size 4 inches by 7 inches and one photograph of size 4 inches by 12 inches.
Figure 14:
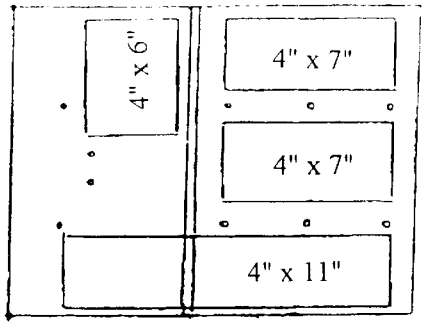
FIG. 14 is a showing of one photograph of size 4 inches by 6 inches and two photographs of size 4 inches by 7 inches and one photograph of size 4 inches by 11 inches.
Figure 19:
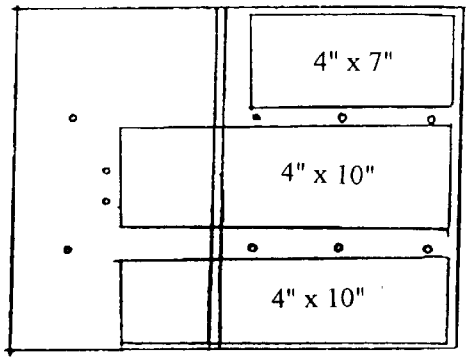
FIG. 19 is a showing of one photograph of size 4 inches by 7 inches and two photographs size 4 inches by 10 inches.
Figure 18:
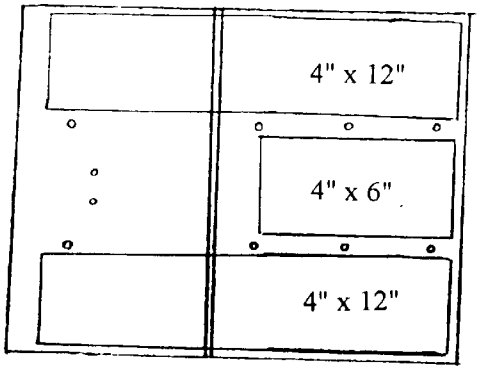
FIG. 18 is a showing of one photograph of size 4 inches by 6 inches and two photographs size 4 inches by 12 inches.
Figure 17:
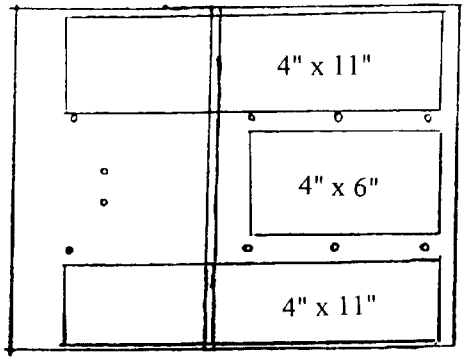
FIG. 17 is a showing of one photograph of size 4 inches by 6 inches and two photographs of size 4 inches by 11 inches.
Figure 20:
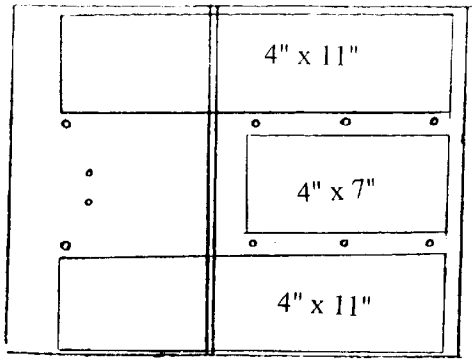
FIG. 20 is a showing of one photograph of size 4 inches by 7 inches and two photographs size 4 inches by 11 inches.
Figure 21:
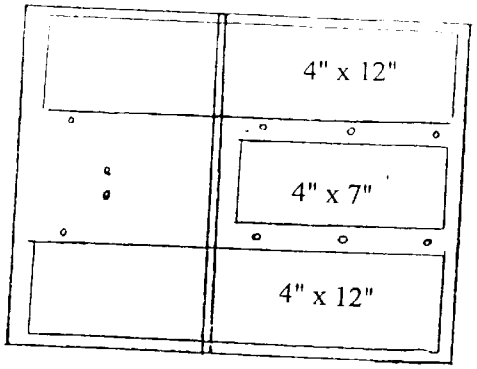
FIG. 21 is a showing of one photograph of size 4 inches by 7 inches and two photographs of size 4 inches by 12 inches.
Figure 22:
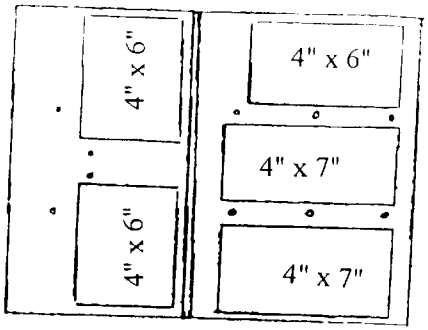
FIG. 22 is a showing of three photographs size 4 inches by 6 inches an two photographs size 4 inches by 7 inches.
Figure 23:
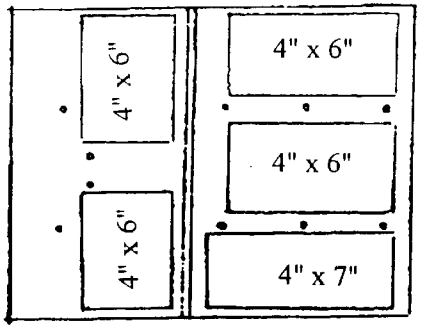
FIG. 23 is a showing of four photographs size 4 inches by 6 inches and one photograph of size 4 inches by 7 inches.
Figure 24:
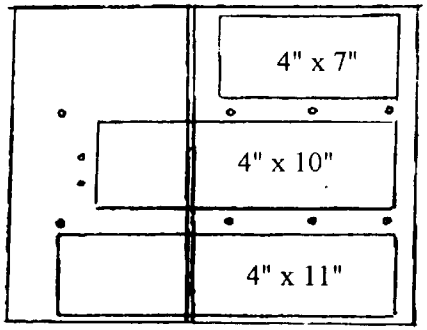
FIG. 24 is a showing of one photograph 4 inches by 7 inches and one photograph 4 inches by 10 inches and one photograph 4 inches by 11 inches.
Figure 25:
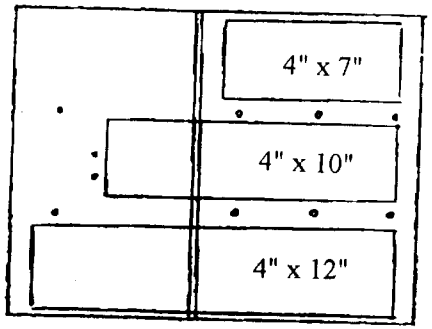
FIG. 25 is a showing of one photograph 4 inches by 7 inches and one photograph 4 inches by 10 inches and one photograph 4 inches by 12 inches.
Figure 27:
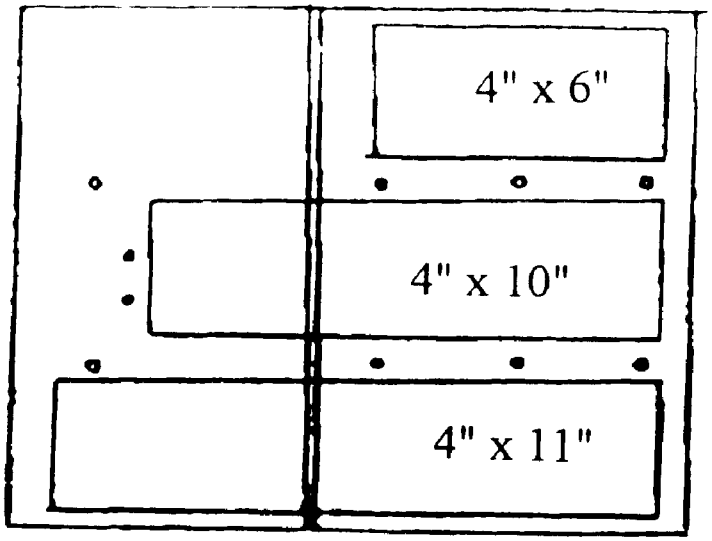
FIG. 27 is a showing of one photograph 4 inches by 6 inches and one photograph 4 inches by 10 inches and one photograph 4 inches by 11 inches.
Figure 26:
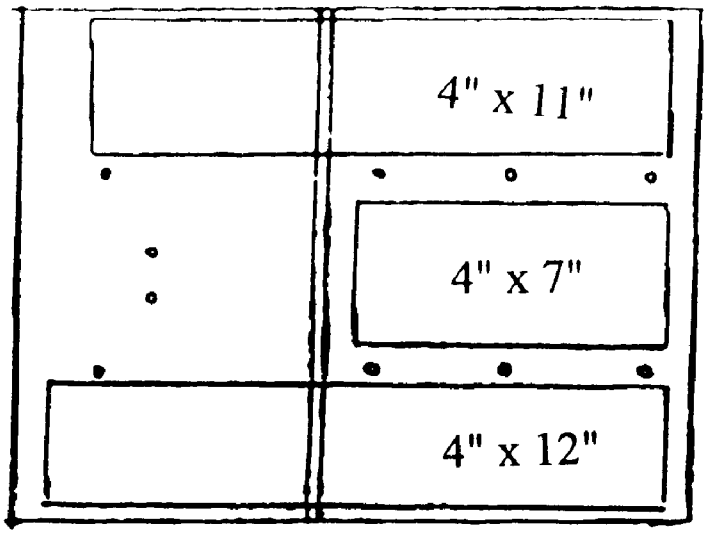
FIG. 26 is a showing of one photograph 4 inches by 11 inches and one photograph 4 inches by 7 inches and one photograph 4 inches by 12 inches.

As can be seen from the foregoing, the various FIGS. 2 through 27 allow for a wide variety of different size photogrpahs to be displayed. These include:

Five photographs of size 4 inch by 6 inch (FIG. 2);

Two photographs of size 4 inches by 6 inches and three photographs of size 4 inches by 7 inches (FIG. 3);

Three photographs of size 4 inches by 10 inches (FIG. 4);

One photograph of size 4 inches by 10 inches, one photograph of size 4 inches by 11 inches and one photograph of size 4 inches by 12 inches (FIG. 5);

One photograph of size 4 inches by 10 inches and two photographs of size 4 inches by 11 inches (FIG. 6);

One photograph of size 4 inches and 10 inches and two photographs of size 4 inches by 12 inches (FIG. 7);

Three photographs of size 4 inches by 6 inches and one photograph of size 4 inches by 10 inches (FIG. 8);

Three photographs of size 4 inches by 6 inches and one photograph of size 4 inches by 11 inches (FIG. 9);

Three photographs of size 4 inches by 6 inches and one photograph of size 4 inches by 12 inches (FIG. 10);

One photograph of size 4 inches by 6 inches and one photograph of size 4 inches by 10 inches and one photograph of 4 inches by 12 inches (FIG. 11);

One photograph of size 4 inches by 6 inches and one photograph of size 4 inches by 11 inches and one photograph of 4 inches by 12 inches (FIG. 12);

One photograph of size 4 inches by 6 inches and two photographs of size 4 inches by 7 inches and one photograph of size 4 inches by 10 inches (FIG. 13);

One photograph of size 4 inches by 6 inches and two photographs of size 4 inches by 7 inches and one photograph of size 4 inches by 11 inches (FIG. 14);

One photograph of size 4 inches by 6 inches and two photographs of size 4 inches by 7 inches and one photograph of size 4 inches by 12 inches (FIG. 15);

One photograph of size 4 inches by 6 inches and two photographs of size 4 inches by 10 inches (FIG. 16);

One photograph of size 4 inches by 6 inches and two photographs of size 4 inches by 11 inches (FIG. 17);

One photograph of size 4 inches by 6 inches and two photographs size 4 inches by 12 inches (FIG. 18);

One photograph of size 4 inches by 7 inches and two photographs size 4 inches by 10 inches (FIG. 19);

One photograph of size 4 inches by 7 inches and two photographs size 4 inches by 11 inches (FIG. 20);

One photograph of size 4 inches by 7 inches and two photographs of size 4 inches by 12 inches (FIG. 21);

Three photographs size 4 inches by 6 inches an two photographs size 4 inches by 7 inches (FIG. 22);

Four photographs size 4 inches by 6 inches and one photograph of size 4 inches by 7 inches (FIG. 23);

One photograph 4 inches by 7 inches and one photograph 4 inches by 10 inches and one photograph 4 inches by 11 inches (FIG. 24);

One photograph 4 inches by 7 inches and one photograph 4 inches by 10 inches and one photograph 4 inches by 12 inches (FIG. 25);

One photograph 4 inches by 11 inches and one photograph 4 inches by 7 inches and one photograph 4 inches by 12 inches (FIG. 26);

One photograph 4 inches by 6 inches and one photograph 4 inches by 10 inches and one photograph 4 inches by 11 inches (FIG. 27);

An alternate embodiment of the invention is shown in FIG. 28. In such embodiment, the interior edge 88 of the small bag is open and spaced exteriorly of he interior edge of the backing sheet forming a sleeve. In this manner, additional photographs may be inserted into pockets adjacent to the interior edge of the backing sheet and spine of the album cover. In addition, the holes in the backing sheets which allow heat sealing of the upper and lower layers of the bags, may be at any of a plurality of locations to form photograph receiving pockets of various sizes and locations. By way of example, the uppermost holes in the small bag are located within an area within 4 inches to 6 inches from the upper edge and at least 4 inches from the open edge. The second uppermost hole is at least 6 inches from the upper edge and is within 3 inches to 4 inches from the open edge. The lowermost hole in the small bag is located within the area within 4 inches to 6 inches from the lower edge and at least 4 inches from the open edge. The second lowermost hole is at least 6 inches from the bottom side line and is within 3 inches to 4 inches from the opening. The small bag is at least 5 inches in width. The large bag is at least 7 inches in width. The large bag is divided into three compartments equally, each compartment being at least 4 inches in height. The page is able to accommodate a large number of combinations of photographs.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A new and improve photograph album page for displaying a plurality of photographs of a wide variety of sizes in a convenient manner comprising, in combination:

a rectangular backing sheet of a flexible opaque material, preferably paper and having an upper edge and a parallel lower edge about 13 inches in length and having an interior edge and a parallel exterior edge about 12.5 inches in length, the backing sheet having an upper surface and a lower surface with a horizontal centerline and a vertical centerline forming an exterior region between the vertical centerline and the exterior edge and an interior region between the vertical centerline and the interior edge;

a plurality of small holes formed through the exterior region of the backing sheet including a lower line of three horizontally aligned holes between the horizontal centerline and the lower edge and an upper line of three horizontally aligned holes between the horizontal centerline and the upper edge;

an additional plurality of small holes formed through the interior region of the backing sheet including an inner line of two vertically aligned holes closely spaced from the interior edge and in alignment with the holes of the upper line and the lower line respectively and an outer line of two vertically aligned holes distantly spaced from the interior edge and closely spaced from the vertical centerline;

a rectangular transparent large bag fabricated of a flexible plastic material, preferably polypropylene, for receiving and displaying photographs, the large bag being formed of an upper layer overlying the upper surface of the sheet and a lower layer overlying the lower surface of the sheet with a sealed upper edge adjacent to the upper edge of the sheet, a sealed lower edge adjacent to the lower edge of the sheet, a sealed closed edge adjacent to the exterior edge of the sheet and an unsealed open edge receiving the exterior region of the sheet and located in proximity to the vertical centerline for the passage of photographs to be received and supported by the large bag;

a rectangular transparent small bag fabricated of a flexible plastic material, preferably polypropylene, for receiving and displaying photographs, the small bag being formed of an upper layer overlying the upper surface of the sheet and a lower layer overlying the lower surface of the sheet with a sealed upper edge adjacent to the upper edge of the sheet, a sealed lower edge adjacent to the lower edge of the sheet, a sealed closed edge adjacent to the interior edge of the sheet and an unsealed open edge receiving the interior region of the sheet and located in proximity to the vertical centerline for the passage of photographs to be received and supported by the small bag and with a small rectangular space formed between the open edges of the large bag and the small bag;

heat sealed couplings between portions of the bags and through the holes to form a unitive page with three similarly sized pockets in the exterior region and a plurality of dissimilarly sized pockets in the interior region; and two spaced circular apertures extending through the small bag and the sheet adjacent to the interior edge to facilitate mounting the page and similar pages into an album.

2. A photograph album page comprising:

a rectangular backing sheet having an upper edge and a parallel lower edge and having an interior edge and a parallel exterior edge;

an exterior region between the vertical centerline and the exterior edge and an interior region between the vertical centerline and the interior edge;

a plurality of small holes formed through the exterior region including a lower line between the horizontal centerline and the lower edge and an upper line between the horizontal centerline and the upper edge;

an additional plurality of small holes formed through the interior region including an inner line of holes closely spaced from the interior edge and an outer line distantly spaced from the interior edge;

a rectangular transparent large bag being formed with an exterior edge adjacent to the exterior edge of the sheet and an unsealed open edge in proximity to the vertical centerline;

a rectangular transparent small bag being formed with an interior edge adjacent to the interior edge of the sheet and an unsealed open edge in proximity to the vertical centerline and with a small rectangular space formed between the open edges of the large bag and the small bag; and couplings between portions of the bags through the holes to form a unitive page.

3. The photograph album page as set forth in claim 2 and further including two spaced circular apertures extending through the sheet adjacent to the interior edge to facilitate mounting the page and similar pages into an album.

4. The photograph album as set forth in claim 2 wherein the interior edge of the small bag is a sealed closed end.

5. The photograph album as set forth in claim 2 wherein the interior edge of the small bag is open and spaced exteriorly of the interior edge of the sheet.

6. The photograph album page as set forth in claim 2 wherein the uppermost hole in the small bag is located within the area within 4 inches to 6 inches from the upper edge and at least 4 inches from the open edge.

7. The photograph album page as set forth in claim 2 wherein the second uppermost hole is at least 6 inches from the upper edge and is within 3 inches to 4 inches from the open edge.

8. The photograph album page as set forth in claim 2 wherein the lowermost hole in the small bag is located within the area within 4 inches to 6 inches from the lower edge and at least 4 inches from the open edge.

9. The photograph album page as set forth in claim 2 wherein the second lowermost hole is at least 6 inches from the lower edge and is within 3 inches to 4 inches from the opening.

10. The photograph album page as set forth in claim 2 wherein the small bag is at least 5 inches in width.

11. The photograph album page as set forth in claim 2 wherein the large bag is at least 7 inches in width.

12. The photograph album page as set forth in claim 2 wherein the large bag is divided into three compartments equally, each compartment being at least 4 inches in height.

13. The photograph album page as set forth in claim 2 wherein the page is able to accommodate a large number of combinations of photographs.

* * * * *